United States Patent [19]

Chang

[11] Patent Number: 4,783,600

[45] Date of Patent: Nov. 8, 1988

[54] AUTOMATIC CONTROLLER OF THE MASTER GAS SWITCH

[76] Inventor: Shui Chang, 3F., No. 1, Alley 16, Lane 428, Lien-Cheng Rd., Chungho City, Taipei Hsien, Taiwan

[21] Appl. No.: 915,740

[22] Filed: Oct. 6, 1986

[51] Int. Cl.[4] ..... H01H 35/00; F23N 5/00

[52] U.S. Cl. ..... 307/116; 307/141; 307/117; 200/61.86; 200/35 R; 200/30 R; 431/69; 251/129.13; 137/65

[58] Field of Search ..... 307/116, 117, 132 R, 307/132 EA, 132 T, 132 M, 140, 141, 141.4; 200/61.86, 35 R, 38 R, 38 B, 20, 21, 24, 27 R, 27 B, 28, 30 R, 36, 37 A, 38 A, 38 FA, 40, 61.03, 61.05, 87; 431/254, 69; 137/65; 251/129.13

[56] References Cited

U.S. PATENT DOCUMENTS

| | | | |
|---|---|---|---|
| 1,903,230 | 3/1933 | Stewart | 251/129.13 |
| 2,025,264 | 12/1935 | Beam | 251/129.13 X |
| 2,515,992 | 7/1950 | Engholdt | 137/65 X |
| 2,807,008 | 9/1957 | Rowell | 307/132 EA |
| 3,286,924 | 11/1966 | Banathy | 200/27 B |
| 3,500,005 | 3/1970 | Brown | 200/38 B |
| 3,624,407 | 11/1971 | Bauer | 307/116 |
| 3,720,858 | 3/1973 | Mercier | 307/117 X |
| 3,727,073 | 4/1973 | Cade | 307/117 |
| 3,772,670 | 11/1973 | Swithenbank et al. | 137/65 |
| 3,854,056 | 12/1974 | Cade | 307/117 |
| 3,892,981 | 7/1975 | Bauer | 307/117 |
| 3,905,748 | 9/1975 | Cairo et al. | 307/116 X |
| 3,935,473 | 1/1976 | Bauer et al. | 307/117 |
| 3,980,852 | 9/1976 | Redfield | 200/38 B X |
| 4,034,235 | 7/1977 | Wade | 307/117 |
| 4,128,387 | 12/1978 | Rayburn et al. | 431/69 X |
| 4,414,439 | 11/1983 | Pomponio | 200/38 R |
| 4,641,043 | 2/1987 | Adams et al. | 307/116 X |

*Primary Examiner*—William M. Shoop, Jr.
*Assistant Examiner*—Sharon D. Logan
*Attorney, Agent, or Firm*—Ostrolenk, Faber, Gerb & Soffen

[57] ABSTRACT

An automatic controller for a master gas switch includes a timer for keeping the switch opened for a selectable time. The controller includes an electrical motor for rapidly closing the switch. The motor is responsive to two conditions: When the timer reaches the end of a selectable time, it energizes the motor to cause the gas switch to close. Secondly, a flame induction rod monitors a gas burner flame, and when the flame stops, such rod causes a relay to close and energize the motor for gas switch closure.

3 Claims, 2 Drawing Sheets

AUTOMATIC CONTROLLER OF THE MASTER GAS SWITCH

FIELD OF THE INVENTION

The present invention relates to an automatic controller for a master gas switch positioned between a gas supply and a gas burner, and more particularly to such a controller that rapidly turns off the gas supply when either a flame of the gas burner stops, or a timer reaches the end of an "on" cycle.

BACKGROUND OF THE INVENTION

The use of gas stoves for cooking is widespread. Although gas is much more convenient than other fuels, such as coal, gas is toxic and is hazardous to persons breathing the gas. The gas flame of a burner can be blown out by the wind and cause unburned gas to leak from a burner. Such unburned gas can easily cause explosion, and threaten life and property. Gas is also used as fuel for water heaters which are often installed outside a room or house. Unburned gas from a gas water heater also poses the above risks.

A further problem with typical gas stoves arises because they are operated manually. When foods are cooked over a gas burner, for example, the users often wander away and forget about the food. Boiling liquid may overflow and drown the burner flame, or food may dehydrate and ruin the cooking utensil, or even cause a fire.

All these problems cause financial and property loss in minor cases, or threaten life and property in major cases.

OBJECTS AND SUMMARY OF THE INVENTION

An object of the invention is to provide an automatic controller of a master gas switch having a timer that automatically turns off the switch at the end of a user-selectable burner-on cycle, or whenever a flame at a gas burner ceases for any reason.

A further object of the invention is to provide an automatic controller for a master gas switch using a single motor for turning off the master gas switch in response to the flame in a gas burner stopping or to a timer reaching the end of a user-selectable burner-on cycle.

The foregoing objects are achieved in an automatic controller for a master gas switch which, in preferred form, includes a valve for controlling the level of gas flow from a gas source to a gas burner. The valve has open and closed positions. The controller includes an electrical rotary motor coupled to the valve for rapidly closing the valve. Power supply means are provided for supplying electrical power to energize the motor. The controller includes a flame-responsive circuit means for connecting the motor to the power supply means when a flame of gas burner stops. The controller preferably also includes a timer-responsive circuit means for connecting the motor to the power supply means at the end of a user-selectable burner-on cycle. A motor stop means is included for inactivating the power supply means after the motor closes the valve to thereby stop the motor.

BRIEF DESCRIPTION OF THE DRAWINGS

Other features and advantages of the invention are described below with reference to the accompanying drawings, in which.

DESCRIPTION OF THE PREFERRED EMBODIMENTS

Figure 1:
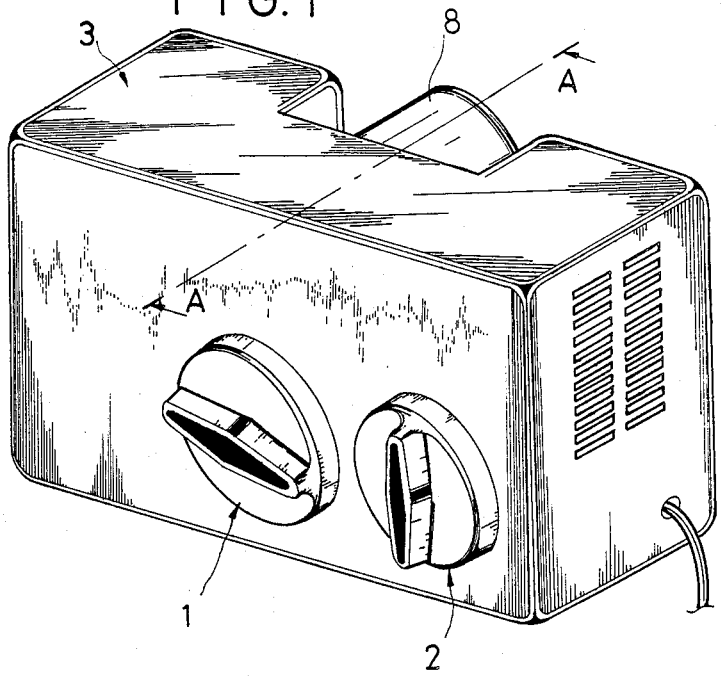
FIG. 1 is a perspective view of an assembled master gas switch of the present invention.
Figure 2:
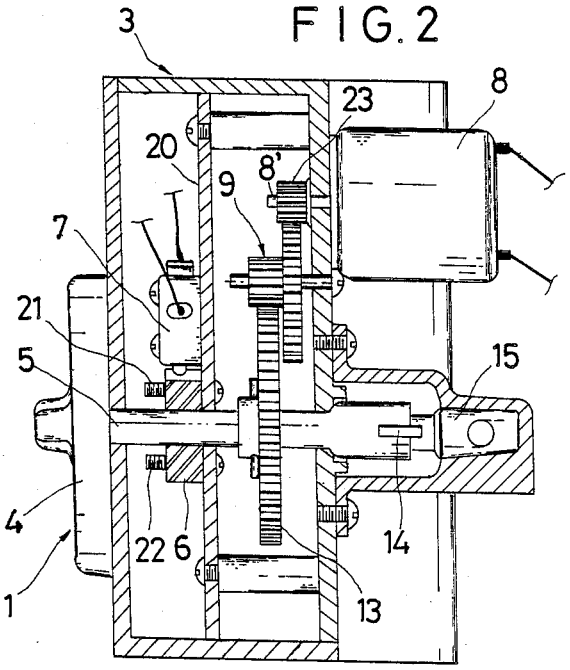
FIG. 2 is a cross-section along arrows A-A in FIG. 1, showing a timing switch, and its interconnection to a motor used to rapidly close the master switch of the invention.

With reference to FIGS. 1 and 2, the invention comprises a rotary switch 1, a timing switch 2, and a housing 3. The rotary switch 1 comprises a knob 4, a drive shaft 5, a compressive wheel 6, a touch switch 7, an electrical motor 8, and a reduction gear set 9. Knob 4 is joined to the outer end of drive shaft 5, on which compressive wheel 6 and a driven gear 13 are mounted. The rear end of drive shaft 5 is connected by a connection plate 14 to a gas switch 15.

Figure 3:
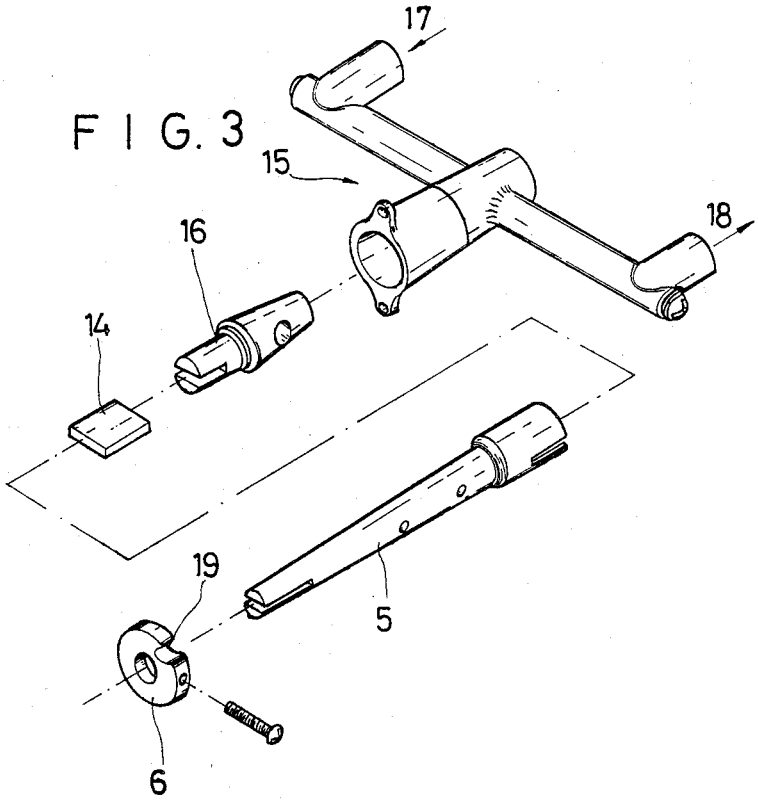
FIG. 3 is an exploded view of selected parts of the master gas switch of the present invention.

FIG. 3 shows selected parts of the master gas switch of the invention, including drive shaft 5 with compressive wheel 6 thereon, connection plate 14, and switch core 16, to which plate 14 is coupled. Gas switch 15 receives air from the direction indicated by an arrow 17 and discharges gas from the direction indicated by an arrow 18.

Figure 4:
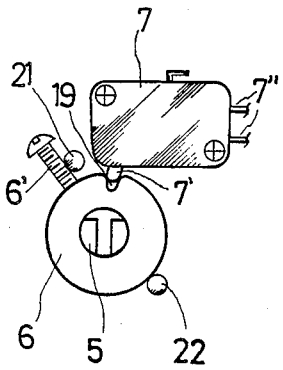
FIG. 4 is a plan view of a cooperating touch switch and compressive wheel for shutting off the power supply to the motor of FIG. 2 after the motor closes a valve.

As shown in FIG. 4, compressive wheel 6 is generally circular and includes a notch 19 on its circumference to release spring-loaded button 7' of touch switch 7 at the end of a user-selectable timing cycle for burner use. When button 7' is released into notch 19, touch switch 7 disconnects the two output lines 7'' from each other to cut off electrical power to the motor 8 (FIG. 2). A pair of positioning posts 21 and 22 are provided on a bottom plate 20 (FIG. 2) to act as stops to a bolt 6' affixed to compressive wheel 6. Posts 21 and 22, thus, determine the possible angles of rotation of compressive wheel 6 and, hence, of drive shaft 5.

Returning to FIG. 2, driven gear 13 on drive shaft 5 is driven into motion by a drive gear 23 on an output shaft 8' of motor 8, via reduction gear set 9.

Figure 5:
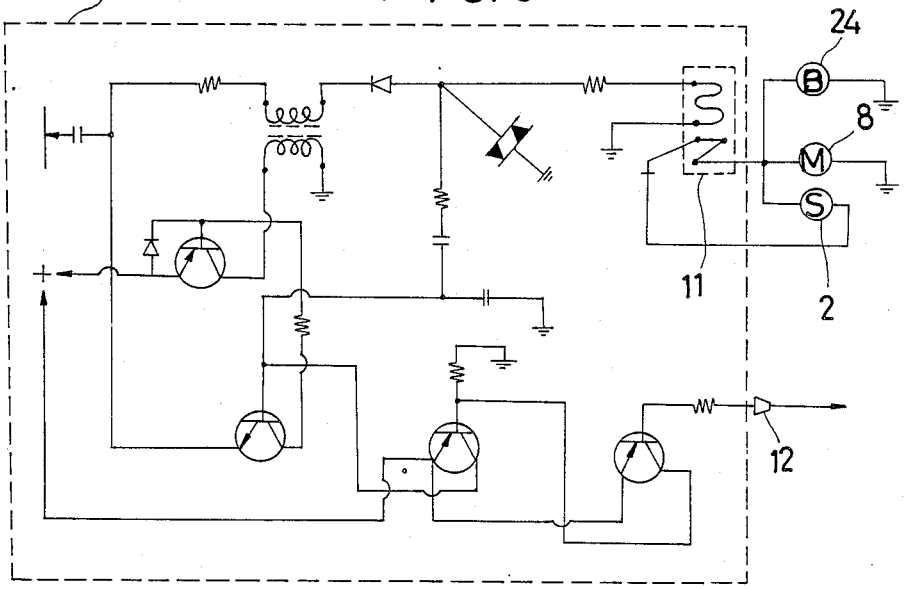
FIG. 5 is a schematic of an exemplary control circuit used in the master gas switch of the invention.

FIG. 5 shows an electrical circuit mounted on a printed circuit board 10 (shown in dashed lines) and including relay 11 and flame induction rod 12. The rod 12 is mounted near the primary flame of the gas burner.

In operation, knob 4 of rotary switch 1 (FIG. 2) can be manually operated to open and close the gas switch 15. When rotated, knob 4 turns compressive wheel 6 on drive shaft 5 to control the on and off states of touch switch 7. When touch switch 7 is in the on state, electric current enters the electrical circuit shown in FIG. 5 at the "+" locations via one of leads 7''. The other lead 7'' is connected to an external power source (not shown). In its off state, touch switch 7 stops supplying electric current to the control circuit of FIG. 5 via lead 7''. This occurs when button 7' (FIG. 4) is released.

As shown in FIG. 5, flame induction rod 12 uses negative electrical potential to maintain relay 11 in a normally open state. When the monitored burner flame is off, flame induction rod 12 ceases producing a negative potential, and instead goes to ground potential. This causes sound generator 24 to emit an alarm sound, and activates relay 11 to close and energize motor 8. Motor 8 then rotates drive gear 23 (FIG. 2) to drive reduction gear set 9 which, in turn, rotates driven gear 13 in drive shaft 5 to turn gas switch 15 to the off position, as shown in FIGS. 2 and 4. Compressive wheel 6 on drive shaft 5 simultaneously rotates to the position shown in FIG. 4 to release button 7' of touch switch 7. This interrupts electric current supplied by leads 7" to the control circuit of FIG. 5. Thus, electric motor 8 automatically shuts off when the master gas switch is closed.

As the above description shows, the master gas switch is automatically turned off whenever a monitored burner flame stops. When timing switch 2, shown in FIG. 5, reaches the end of a burner-on cycle, it also completes a circuit to energize motor 8 and turn off the master gas switch.

Although the present invention has been described on connection with a plurality of preferred embodiments thereof, many other variations and modifications will now become apparent to those skilled in the art. It is preferred, therefore, that the present invention be limited not by the specific disclosure herein, but only by the appended claims.

I claim:

1. An automatic controller for a master gas switch, comprising:

a valve for controlling the level of gas flow from a gas source to a gas burner, the valve having open and closed positions;

an electrical rotary motor coupled to the valve for rapidly closing the valve;

power supply means for supplying electrical power to energize the motor;

flame-responsive circuit means for connecting the motor to the power supply means when a flame of the gas burner stops;

time-responsive circuit means for connecting the motor to the power supply means at the end of a user-selectable burner-on cycle;

motor stop means for inactivating the power supply means after the motor closes the valve to thereby stop the motor;

the stopper means includes:

a drive shaft coupling the motor and the valve;

a compressive wheel affixed to the drive shaft and having a notch on its circumference; and a touch switch cooperating with the compressive wheel and having a release button arranged to move into the notch when the motor has rotated the drive shaft sufficiently to close the valve.

2. The automatic controller of claim 1, wherein the flame-responsive circuit means includes a flame sensor in circuit with an electrical relay, the relay being closed to energize the motor when the flame sensor detects that a flame stops.

3. The automatic controller of claim 1, wherein the flame sensor comprises a flame induction rod.

* * * * *